United States Patent [19]

Joy

[11] 4,447,281

[45] May 8, 1984

[54] DISPENSER FOR APPLYING ADHESIVE TAPE

[76] Inventor: Richard L. Joy, 1011 San Eduardo, Henderson, Nev. 89015

[21] Appl. No.: 428,878

[22] Filed: Sep. 30, 1982

[51] Int. Cl.[3] ..... B32B 31/00

[52] U.S. Cl. ..... 156/250; 156/523; 156/577; 225/33; 225/39; 225/91

[58] Field of Search ..... 156/523, 526, 527, 574, 156/577, 579, 250; 225/33, 39, 91

[56] References Cited

U.S. PATENT DOCUMENTS 2,493,737 1/1950 Burns .
2,727,646 12/1955 David ..... 156/523
3,438,835 4/1969 Chen et al. .
3,850,779 11/1974 Pearson .
3,902,956 9/1975 Thompson .
4,097,328 6/1978 Urushizaki .

*Primary Examiner*—Edward C. Kimlin
*Assistant Examiner*—Timothy W. Heitbrink
*Attorney, Agent, or Firm*—Gerald L. Moore

[57] ABSTRACT

A tape dispenser for adhesive tape comprising a housing (10) for rotatably supporting a tape roll (12) with the tape end (11) exiting the housing through an opening (22) and passing around a guide (21). To sever the tape, a cutting mechanism (25) is provided comprising rollers (29) supported on a rotatable shaft (27) with radially extending cutting members (26) positioned to contact the tape. When severing of the tape is desired, the rollers are brought into contact with the surface to which the tape is being applied to move the cutting members into contact with and at the same velocity as the tape for effective cutting.

7 Claims, 5 Drawing Figures

DISPENSER FOR APPLYING ADHESIVE TAPE

FIELD OF THE INVENTION

This invention relates to a dispenser for applying pressure sensitive adhesive tape that allows the tape to be dispensed and cut off with one hand.

BACKGROUND OF THE INVENTION

Tape dispensers for pressure sensitive adhesive tape are well known and widely used. Most such dispensers provide for the severing of the tape by use of a cutting edge fixed on the outside of the dispenser. Such fixed cutters are only marginally effective in serving the tape and often take both hands to use. Such cutters frequently are dull because, due to their exposed position, they are susceptible to being hit against objects during use of the dispenser. Also, if the cutting member is made too sharp it is dangerous to the user. The stationary cutter is also found to be ineffective because it requires a considerable tensile force to be exerted on the tape before it will sever the tape, sometimes to the point of causing the tape to crease and to pull from the surface to which it has been applied.

To alleviate such problems there have been other solutions suggested, generally in the area of providing movable cutters which can be actuated into a position to contact and sever the tape. Some examples of such dispensers are shown in U.S. Pat. No. 2,493,737, Device for applying Adhesive Tape, issued to Burns on Jan. 10, 1950; U.S. Pat. No. 3,850,779, Tape Applicator, issued to Pearson on Nov. 26, 1974; U.S. Pat. No. 3,902,956, Pressure Sensitive Tape Applicating System, issued to Thompson on Sept. 2, 1975; and U.S. Pat. No. 4,097,328, Tape Cutter, issued to Urishizaki on June 27, 1978. While such applicators frequently will allow the tape to be applied with one hand while leaving the other hand free to hold the material being taped, still the mechanisms are quite complicated and expensive to make. Additionally, the cutter members usually function while stationarily positioned relative to the tape thereby still requiring a considerable tensile force to be applied to the tape for the cutter to be effective. These devices do offer the advantage, however, of protecting the cutter thereby permitting it to remain sharp, and in most instances, permitting resonably safe use of the cutter.

One other example of a dispenser with a cutter is shown in U.S. Pat. No. 3,438,835, Apparatus for Laminating and Cutting Including a Pair of Rollers with Cutting Edges, issued to Chen, et al., on Apr. 15, 1969. This dispenser recognizes the benefits of providing a cutting member incorporated in cutting rollers to laminate separate sheets of material. The cutting edges on the rollers are flush with or recessed below the surface of the resilient material and do not effect a cutting action until the rollers are pressed together.

Thus it can be seen that while several efforts have been to provide effective cutting mechanisms with dispensers and tape handling devices, all have certain drawbacks primarily involving the complexity of the mechanism or difficulty of use. It is the purpose of the present invention to provide an improved cutting mechanism for a tape dispenser which works effectively while allowing the user to apply the tape with one hand.

SUMMARY OF THE INVENTION

A dispenser for applying pressure sensitive adhesive tape to a surface including a housing for holding a roll of tape, a guide for directing the tape from the housing onto the surface, and a cutting mechanism positioned along the tape path and outside the housing including a roller for contacting the surface. The cutting mechanism supports at least one cutting member extending radially outward from the axis of rotation of the roller. When it is desired to sever the tape, the dispenser is shifted to bring the tape into contact with the cutting mechanism as the roller is rolled across the surface to move the cutting member at the same speed as the tape and contact and thereby sever the tape.

DESCRIPTION OF THE INVENTION

Figure 5:
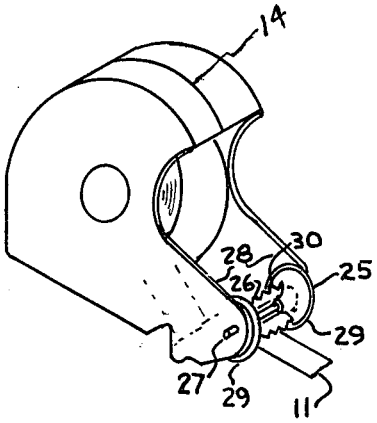
FIG. 5 is a perspective view of the dispenser.

In the Figures is shown a dispenser 10 which is hand held for dispensing a continuous strip 11 of transparent or other type of adhesive tape from a tape roll 12. This general type of dispenser is well known and commonly used for dispensing tape which includes an adhesive on one surface. While not shown, such dispensers generally can be separated along a center line 14 (see FIG. 5) for the insertion of tape roll. The manner of holding the dispenser halves together is not shown but usually comprises a plurality of projections which fit into recesses in the other half. The tape roll 12 is usually wound around a center tube 15 so as to form a center opening 16. This center opening is sized to fit over the tube 13 formed within the tape dispenser. Thus the tape roll can rotate as the tape is peeled from the outer periphery.

The dispenser comprisesd a split outer wall 17 extending around the tape roll and terminating in a flat or planar bottom wall 18. The forward portion of the housing is preferably cut away at 19 to facilitate initial feeding of the tape through the housing as will be explained later.

As the tape strip 11 is peeled from the roll it passes vertically downward, around a cylindrical guide 21 and out of the dispenser through an opening 22 in the bottom wall 18. The guide 21 extends beyond the bottom wall 18 to press against the tape and adhere it to the surface to which it is being applied. Thus the tape can be dispensed in the manner shown in FIGS. 1 and 5 by pressing the extending end thereof against a surface and then moving the dispenser along the surface in a direction away from that end so as to cause the tape to be pressed against the surface as it is peeled from the tape roll. Because the members being taped are frequently being held by the other hand it is advantageous if the dispenser can be manipulated with only one hand. In past dispensers such has usually been possible until it was necessary to sever the tape. As was pointed out before, the cutting mechanisms in prior dispensers have not functioned in an entirely satisfactory manner, and it is to this end that the subject invention is provided.

Figure 1:
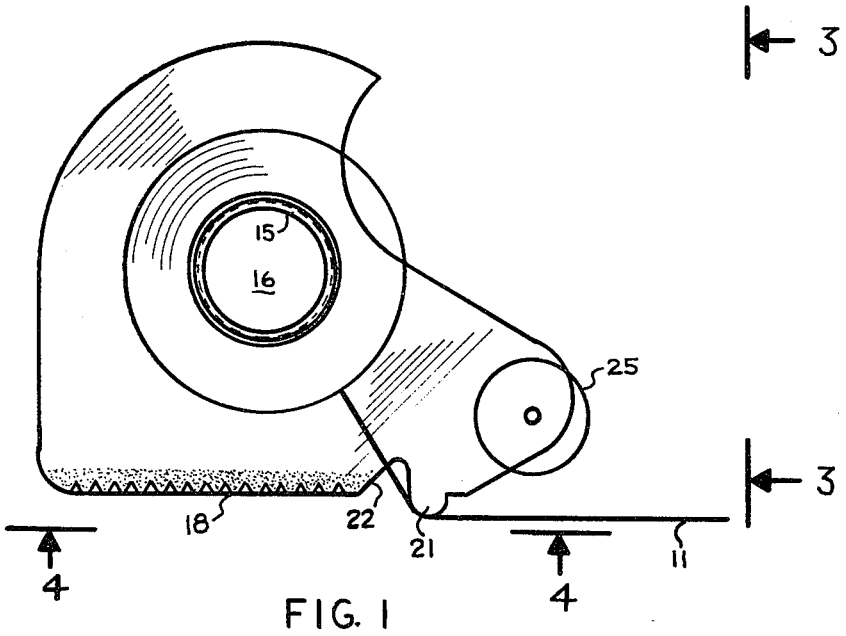
FIG. 1 is a side view of the dispenser employing the subject invention and positioned to dispense tape along a flat surface.

In accordance with the present invention there is provided a cutting mechanism 25 which, as the tape is normally dispensed in the manner shown in FIG. 1, is out of contact with the tape strip, that is, as the bottom surface 18 is pressed against the surface on which the tape is being applied. The flat bottom surface of the dispenser tends to align the dispenser housing so tha tape is dispensed around the guide 21 and along the flat surface.

A plurality of cutting members 26 are supported around a center shaft 27 extending between the side extension 28 on the dispenser housing for cutting the tape. The cutting mechanism also includes a pair of rollers 29, one positioned against each side wall extension. Extending between these rollers is one or more of the cutting members 26 generally fixed to the rollers and in a position abutting the shaft 27. These cutters are each sharpened on the outer edge 30.

Figure 2:
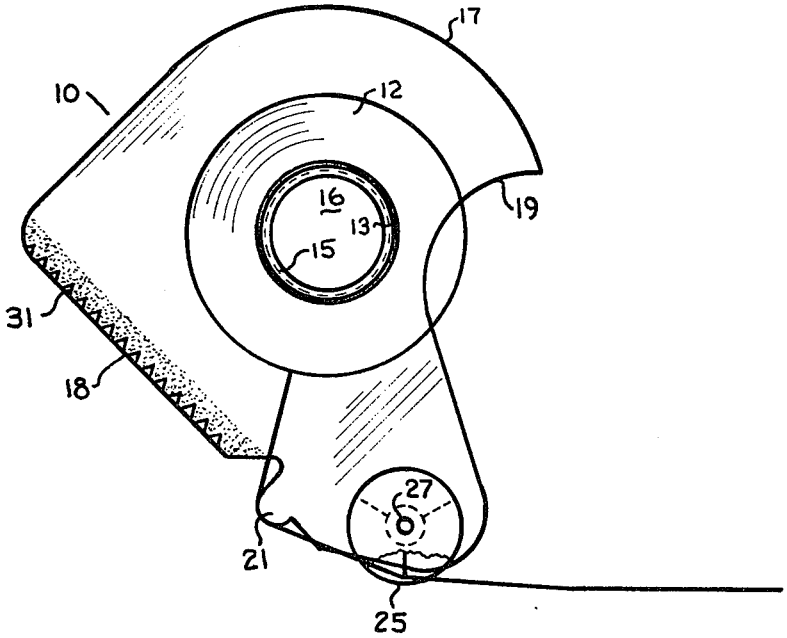
FIG. 2 shows the manner in which the dispenser is tilted to position the cutting mechanism for severing the tape.
Figure 3:
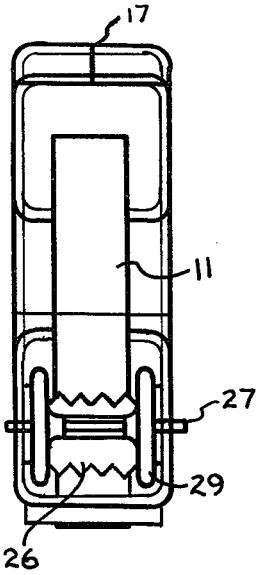
FIG. 3 is a view along the line 3—3 of FIG. 1.
Figure 4:
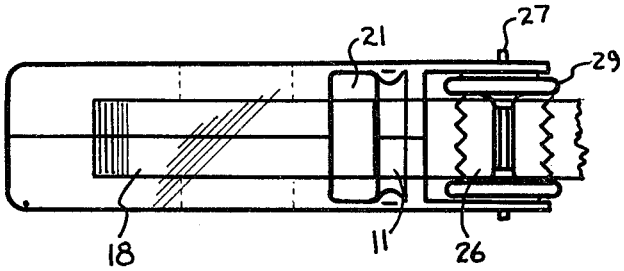
FIG. 4 is a view along the line 4—4 of FIG. 1.

In operation the dispenser is pulled along the surface in the attitude shown in FIG. 1 to dispense the strip 11 along the surface. When it is desired to sever the tape, the dispenser is tilted to the position shown in FIG. 2. When in the position shown in FIG. 2 the tape wraps around the guide 21 and passes between the rollers 29 which now are in contact with the surface on which the tape is being applied. The rollers thus rotate with the shaft 27 as the dispenser is moved along the surface, thereby moving the cutters 26 at approximately the same peripheral speed as the tape is passing the cutting mechanism i.e. there is little or no relative motion between the individual cutters and the tape. This permits a close contact between the tape and the cutter's outer cutting edge 30 serving to sever the tape efficiently and effectively at the position desired. The cutting position is that position in which the dispenser is tilted upward bringing the cutting mechanism into contact with the tape.

After the tape is severed by contact with the cutting mechanism, a small portion of the remaining tape, which is still part of the original tape roll, will protrude past the gudie 21. This protruding tape will be positioned so that a repetetive application can still be made with one hand. There is no need for tape feed or adjustment between applications.

For storage purposes, the tape can be wrapped backwards along the outer surface 18. The tape will naturally stick to the surface 18 and can be peeled off and once again be placed into contact with a surface to which the tape is to be applied. This surface includes a plurality of grooves 31 which limit the degree to which the tape will stick to the surface and also permit easy separation of the tape from the surface by insertion of a fingernail into a groove and beneath the tape. Additionally, the surface 18 can be roughened to form what is commonly referred to as an "orange peel" surface to also limit the contact between the adhesive surface of the tape and the dispenser surface and permit easier release of the tape for further use.

I claim:

1. A dispenser for applying adhesive pressure sensitive tape to a surface, comprising:

a housing including:

means to hold a roll of pressure sensitive tape and allowing rotation of the roll as the tape is peeled from the roll;

a guide for directing the tape from the dispenser onto the surface, and a cutting mechanism to be contacted by said tape as it is directed towards said surface, said cutting mechanism comprising a roller mounted for rotation about a shaft supported for rotation on said housing and having attached thereto at least one cutting member extending radially from said shaft and in a position to contact and sever said tape.

2. A dispenser as defined in claim 1 wherein said roller and cutting member are positioned so as not to normally contact said tape as it is dispensed from said housing but positioned such that rotation of said housing will bring said cutting member into contact with said tape.

3. A dispenser as defined in claim 1 wherein said guide and said roller are positioned to contact said surface onto which the tape is being applied.

4. A dispenser as defined in claim 3 wherein said housing includes an outer planar wall member positioned adjacent said guide with said guide being located to contact said surface as said tape is being dispensed.

5. A dispenser as defined in claim 4 wherein said roller is positioned so as not to contact said surface simultaneously with said guide.

6. A dispenser as defined in claim 5 wherein said cutting mechanism includes a plurality of cutting members extending radially outward from said shaft.

7. The method of dispensing adhesive pressure sensitive tape onto a surface comprising the steps of:

positioning a roll of the tape in a housing in a manner to allow rotation of said roll;

forming in said housing a guide to permit the tape stripped from the roll to pass out of said housing and be pressed onto a surface;

mounting adjacent said guide and on said housing a cutting mechanism comprising a roller mounted for rotation about an axis of rotation and positioned on said housing to contact and roll along said surface as the tape is being dispensed, said cutting mechanism also including at least one cutting member extending radially from said axis of rotation and supported to rotate thereabout with said roller; ;p1 placing said housing adjacent said surface, pressing the end of said tape into said surface and pulling said dispenser therealong to strip the tape and adhere it onto said surface; and tilting said housing to cause said roller to contact and roll along said surface and to bring said cutting member into contact with and thereby sever said tape.

* * * * *